US005641280A

United States Patent [19]

Timuska

[11] Patent Number: 5,641,280

[45] Date of Patent: Jun. 24, 1997

[54] ROTARY SCREW COMPRESSOR WITH SHAFT SEAL

[75] Inventor: Karlis Timuska, SpÅnga, Sweden

[73] Assignee: Svenska Rotor Maskiner AB, Stockholm, Sweden

[21] Appl. No.: 481,318

[22] PCT Filed: Dec. 8, 1993

[86] PCT No.: PCT/SE93/01057

§ 371 Date: Jun. 14, 1995

§ 102(e) Date: Jun. 14, 1995

[87] PCT Pub. No.: WO94/15100

PCT Pub. Date: Jul. 7, 1994

[30] Foreign Application Priority Data

Dec. 21, 1992 [SE] Sweden ..... 9203841

[51] Int. Cl.[6] ..... F04C 18/16; F04C 27/00; F16C 33/80; F16J 15/40

[52] U.S. Cl. ..... 418/102

[58] Field of Search ..... 418/102, 104; 277/59, 70

[56] References Cited

U.S. PATENT DOCUMENTS

| | | | |
|---|---|---|---|
| 1,188,189 | 6/1916 | Little | 277/70 |
| 2,331,641 | 10/1943 | Walker | 277/70 X |
| 3,265,293 | 8/1966 | Schibbye | 418/100 |
| 3,975,123 | 8/1976 | Schibbye . | |
| 4,329,126 | 5/1982 | Nishimura | 418/104 X |
| 4,477,223 | 10/1984 | Giroux . | |
| 5,228,298 | 7/1993 | Kun et al. | 418/104 X |

FOREIGN PATENT DOCUMENTS

| | | |
|---|---|---|
| 2 569 780 | 3/1986 | France . |
| 1 164 201 | 9/1969 | United Kingdom . |
| 2 008 691 | 6/1979 | United Kingdom . |

*Primary Examiner*—Richard E. Gluck

*Attorney, Agent, or Firm*—Frishauf, Holtz, Goodman, Langer & Chick

[57] ABSTRACT

A rotary screw compressor for oil-free air, wherein at least one of the shaft journals (11) of the rotors (10) has a seal arrangement between the rotor (10*d*) and an oil-lubricated bearing (12). The seal arrangement includes at least three frictionless seals (13, 14, 15) separated by annular chambers (16,17). The outermost annular chamber (17) is connected to a source of pressurized air through a supply channel (19) for supplying blocking air to the seal, and another (16) of the annular chambers communicates with a withdrawal channel (18).

9 Claims, 2 Drawing Sheets

ROTARY SCREW COMPRESSOR WITH SHAFT SEAL

BACKGROUND OF THE INVENTION

The present invention relates to a rotary screw compressor for oil-free air provided with inlet channel means and outlet channel means and having at least one compression stage, each stage including at least one rotor with at least one shaft journal mounted in oil-lubricated bearing means, which shaft journal is provided with seal means between the rotor and the bearing means, which seal means include at least three frictionless seal means surrounding the shaft journal and a plurality of annular chambers surrounding the shaft journal, which frictionless seal means and annular chambers are arranged in an alternating sequence along the shaft journal.

In such compressors handling oil-free air an effective seal between the working space and the bearings is necessary in order to avoid that oil-contaminated air from the bearing housing mixes with the compressed air which can be dry or contain water. The use of direct contact mechanical seals for that purpose results in high friction losses. This is avoided with the type of seal arrangement mentioned above where frictionless seals are used together with a blocking gas, e.g. air.

Seals of this type are disclosed in U.S. Pat. No. 3,975,123 and FR-A-2 569 780.

In U.S. 3,975,123 the seal arrangement has four frictionless seals with three annular chambers between them. Blocking air is supplied to the intermediate annular chamber of the seal and flows outward towards the outermost annular chamber, from which it is withdrawn together with oil leaking from oil-lubricated bearing means. The innermost annular chamber is inactive at full load and connected to inlet pressure at part load for supply of air.

In FR-A-2 569 780 a similar seal device is applied to a two stage air compressor, but in this case only two annular chambers are present. Also in this disclosure the supply and withdrawal of blocking air is such that the blocking air flows in the outward direction.

The relative localisation of the supply and withdrawal of the blocking air in the known devices has the consequence that oil-contaminated air from the roller bearings leaks to the withdrawal channel where it is mixed with the blocking air and leaking air from the compression stage. This causes a problem in that the withdrawn air has to be purified if it is led to the compressor inlet or to the ambient atmosphere.

The object of the present invention is to attain a seal arrangement of the kind in question in which the above described problem is overcome.

SUMMARY OF THE INVENTION

According to the invention this has been achieved in that the outermost annular chamber is connected via a supply channel to a source of pressurized air, and a withdrawal channel is connected to another of the annular chambers positioned between said outermost annular chamber. Outermost means being most remote from the rotor.

By supplying the blocking air to the outermost annular chamber, the oil-contaminated air in the bearing housing is prevented from leaking along the shaft journal to the withdrawal channel. The air withdrawn from the seal means thus is free from oil.

The invention is particularly, but not exclusively intended for a multistage compressor, in which case each of the withdrawal channel means are connected to a common collecting channel communicating with the compressor inlet channel downstream variable throttling means in the inlet channel.

In an alternative embodiment when applied to a multistage compressor the withdrawal channel means at the high pressure end of the end stage are directly connected to atmosphere, whereas all the other withdrawal channel means are selectively connected to atmospheric air via shut-off valve means.

Further advantageous embodiments of the invention are specified in the dependent claims.

The invention will be further explained through the following detailed description of preferred embodiments thereof and with reference to the accompanying drawings.

Figure 1:
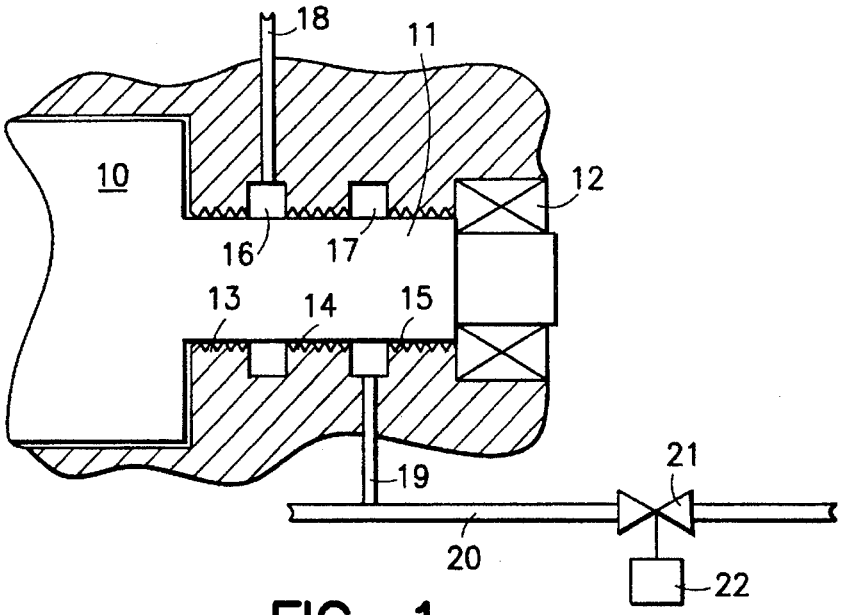
FIG. 1 is a schematic section through a part of a compressor according to the invention.

FIG. 1 shows a part of one of the screw rotors 10 in a twin screw compressor. The shaft journal 11 at the high pressure end of the rotor 10 is mounted in roller bearings 12, which are oil-lubricated. Between the rotor 10 and the roller bearings there is a seal arrangement consisting of first 13, second 14 and third 15 labyrinth seals. Other kinds of frictionless seals of course can be used, e.g. of the floating bushing type as disclosed in U.S. Pat No. 5,009,583. And any if the three seals can be composed of a plurality of seal units.

Between the first and second labyrinth seal there is an inner annular chamber 16 communicating with a withdrawal channel 18 and between the second and third labyrinth seals there is an outer annular chamber 17 communicating with a supply channel 19. The supply channel 19 is connected to the outlet side of the compressor through a main supply channel 20. In the main supply channel 20 there is provided a valve 21 for reducing the pressure to a range within 1,1 to 2,0 bars, preferably within 1,3 to 1,5 bars. The withdrawal channel 18 is connected to the compressor inlet.

In operation air of about 1,4 bars is supplied to the outer annular chamber 17. A fraction of the supplied air leaks outward towards the bearings 12 thereby preventing any oil-contaminated air to leak inward from the bearings 12. The rest of the blocking air leaks inward to the inner annular chamber 16, from where it is drained through the withdrawal channel 18 to the compressor inlet.

Figure 2:
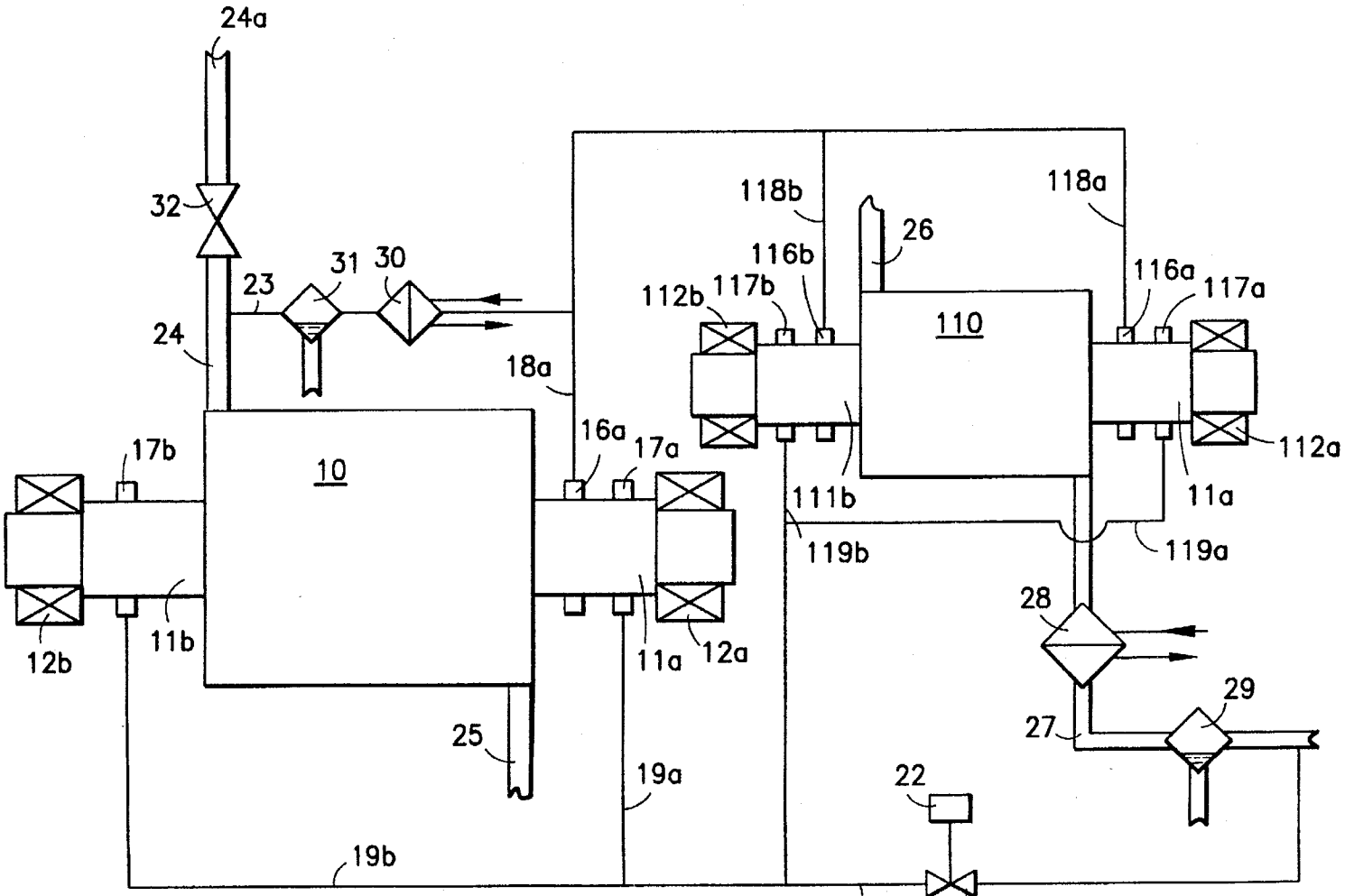
FIG. 2 is a diagrammatic illustration of a two stage compressor according to the invention.

FIG. 2 illustrates an embodiment of the invention applied to a two-stage screw compressor. In each stage a pair of screw rotors cooperate to form compression chambers, but only one of the rotors 10, 110 in each pair can be seen in the figure. Screw rotor 10 operates in the first stage and screw rotor 110 in the second stage. The first stage has an inlet or low pressure channel 24 and a channel **24*a* in open communication with atmospheric air and an outlet channel 25, which forms an intermediate pressure channel and is connected to the inlet channel 26 of the second stage. The compressed air leaves the compressor through the outlet or high pressure channel 27** of the second stage.

Each rotor 10, 110 is provided with a shaft journal **11*a*, 11*b*, 111*a*, 111*b* at each end, which are mounted in roller bearing means 12*a*, 12*b*, 112*a*, 112*b*. Between each rotor 10, 110 and each roller bearing means 12*a*, 12*b*, 112*a*, 112*b* there is provided a seal arrangement. The seal around the shaft journal 11b at the low pressure end of the first stage has only two labyrinth seals separated by one single annular chamber 17b, whereas the seal around the shaft journal 11a at the high pressure end of the first stage and those around the shaft journals 11a, 11b of the second stage are similar to the seal illustrated in FIG. 1. Each of them thus has three labyrinth seals or the like separated by an inner 16a, 116a, 116b and an outer 17a, 117a, 117b annular chamber. Each of the inner annular chambers 16a, 116a, 116b communicates with a withdrawal channel 18a, 118a, 118b, respectively, which channels are connected to the compressor inlet channel 24 through a common collecting channel 23, having cooling 30 and liquid separating 31 devices. Each of the outer annular chambers 17, 117a, 117b and the annular chamber 17b around the shaft journal 11b at the low pressure end of the first stage communicate with a supply channel 19a, 119a, 119b, 19b, respectively, which channels through a main supply channel 20 are connected to the compressor outlet channel 27 downstream cooling 28 and liquid separating 29 devices provided in the outlet channel 27. In the main supply channel 20 there is an adjustable valve 21 for reducing the pressure from the compressor outlet channel 27. The pressure reducing valve 21 is controlled by a governing unit for maintaining a pressure of about 1,3 to 1,5 bar in the supply channels 19a, 19b, 119a, 119b**.

The compressor inlet channel 24 is provided with a variable throttling valve 32 for regulating the compressor capacity. The connection between the collecting channel 23 and the compressor inlet channel 24 is downstream that throttling valve 32.

The rotors not shown in the figure, which cooperate with the rotors 10 and 110 also have similar seals around their shaft journals, and their supply and withdrawal channels are also connected to the main supply channel 20 and the collecting channel 23, respectively.

In operation blocking air is supplied from the compressor outlet channel 27 through the main a supply channel 20 and the individual supply channels 19a, 19b, 119a, 119b to the annular chamber 17b around the shaft journal 11b at the low pressure end of the first stage and to the outer annular chambers 17a, 117a, 117b around all the other shaft journals 11a, 111a, 111b. From annular chamber 17b the blocking air leaks to the low pressure side of the compressor space, and from the annular chambers 17a, 117a, 117b the air leaks to the corresponding inner annular chamber 16a, 116a, 116b, from where it is drained through the individual withdrawal channels 18a, 118a, 118b and the collecting channel 23 to the compressor inlet channel 24. Since the connection of the collecting channel 23 to the compressor inlet channel 24 is located downstream the inlet throttle 32, the pressure on the withdrawal side will always be low enough to secure an effective drainage, also at part load.

Figure 3:
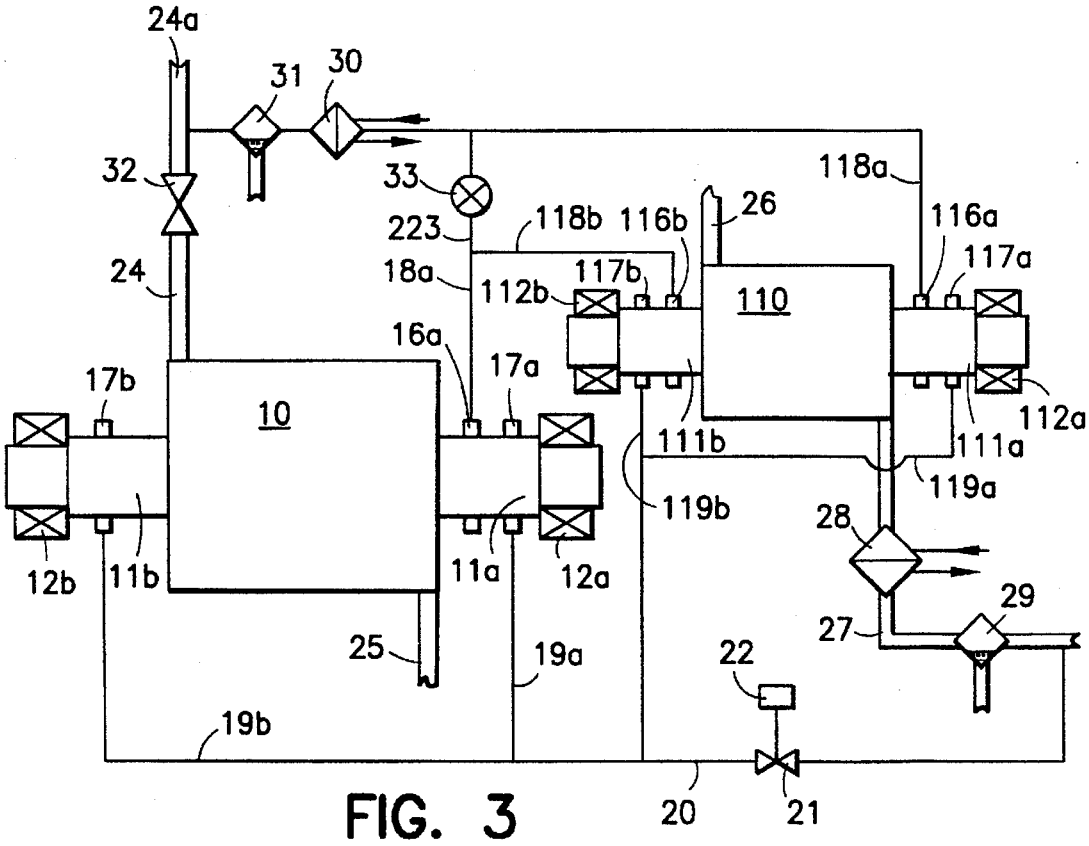
FIG. 3 is an illustration of a modification of the compressor in FIG. 2.

An alternative embodiment of a two-stage compressor according to the invention is illustrated in FIG. 3, which embodiment differs from the above described one only in respect of the withdrawal system. In this embodiment the withdrawn blocking air reaches the compressor inlet channel 24 and a channel 24a in open communication with atmospheric air upstream the inlet throttle 32. The withdrawal channel 118a from the shaft journal 111a at the high pressure end of the second stage is directly connected to the compressor inlet channel 24. In a collecting channel 223 communicating the other withdrawal channels 18a, 118b to the compressor inlet channel 24 a shut-off valve 33 is provided, which at full load is kept open. If the compressor is throttled the shut-off valve will be closed in order to avoid a back flow in these withdrawal channels 18a, 118b due to the low pressure which under such conditions prevails in the first compressor stage and at the low pressure end of the second stage.

I claim:

1. A rotary screw compressor for oil-free air, comprising:

an inlet channel (24);

an outlet channel (27); and at least one compression stage, each compression stage including at least one screw rotor (10; 10, 110) with at least one shaft journal (11; 11a, 111a, 111b) mounted in an oil lubricated bearing (12; 12a, 112a, 112b), said at least one shaft journal (11; 11a, 111a, 111b) having a seal between said screw rotor (10; 10, 110) and said oil lubricated bearing (12; 12a, 112a, 112b);

said seal including at least three frictionless seal portions (13, 14, 15) surrounding said at least one shaft journal (11, 11a, 111a, 111b) and a plurality of annular chambers (16, 17; 16a, 116a, 116b, 17a, 117a, 117b) surrounding said shaft journal (11; 11a, 111a, 111b), said frictionless seal portions (13, 14, 15) and said annular chambers (16, 17; 16a, 116a, 116b, 17a, 117a, 117b) being arranged in an alternating sequence along said at least one shaft journal (11, 11a, 111a, 111b);

a supply channel (19, 19a, 119a, 119b) connecting an outermost one of said annular chambers (17, 17a, 117a, 117b) to a source of pressurized air; and a withdrawal channel (18, 18a, 118a, 118b) connected to another of said annular chambers (16, 16a, 116a, 116b), said withdrawal channel being positioned between said outermost annular chamber (17, 17a, 117a, 117b) and the rotor, wherein the term outermost is being defined as most remote from the screw rotor.

2. A rotary screw compressor according to claim 1, having a plurality of said compression stages, each compression stage including a pair of co-operating screw rotors and wherein said inlet channel (24) includes a variable throttling device (32), and said withdrawal channel (18a, 118a, 118b) is connected to said inlet channel (24) downstream of said variable throttling device (32).

3. A rotary screw compressor according to claim 2, including a plurality of said withdrawal channels connected to said inlet channel downstream of said variable throttling device.

4. A rotary screw compressor according to claim 1, having a plurality of said compression stages, each compression stage including a pair of co-operating screw rotors and wherein said withdrawal channel (118a) from said seal surrounding a shaft journal (111a) at a high pressure end of an end compression stage is in open communication with atmospheric air, whereas each of said withdrawal channels (18a, 118b) from all other of said seals are connected to a collecting channel (223), said collecting channel (223) being selectively connected to atmospheric air via a shut-off valve (33).

5. A rotary screw compressor according to any one of claims 1, 2, 3 or 4, comprising:

a main supply channel (20) connected to said source of pressurized air;

a further supply channel (19, 19a, 119a, 119b) connected to said main supply channel (20).

6. A rotary screw compressor according to claim 5, wherein said source of pressurized air comprises said outlet channel (27).

7. A rotary screw compressor according to claim 6, wherein said main supply channel (20) comprises a variable pressure reducing device (21).

8. A rotary screw compressor according to claim 7, wherein said variable pressure reducing device (21) is controlled by a governing device (22) for maintaining a pressure in each of said outermost annular chambers (17, 17*a*, 117*a*, 117*b*) within 1,1 to 2,0 bars.

9. A rotary screw compressor according to claim 6, wherein:

said outlet channel (27) comprises a liquid separator (29); and said source of pressurized air comprises said outlet channel (27) downstream of said liquid separator (29), so that substantially dry air is supplied to said outermost annular chamber (17; 17*a*, 117*a*, 117*b*).

* * * * *

UNITED STATES PATENT AND TRADEMARK OFFICE

CERTIFICATE OF CORRECTION

PATENT NO. : 5,641,280
DATED : June 24, 1997
INVENTOR(S) : TIMUSKA

It is certified that error appears in the above-indentified patent and that said Letters Patent is hereby corrected as shown below:

Column 2, line 57, delete "a channel 24*a* in open com-"
line 58, delete "munication with atmospheric air and"

Column 3, line 12, after "24" insert --a channel 24*a* in open communication with atmospheric air-- line 61, delete "and a channel 24*a* in open communication with atmo-"
line 62, delete "spheric air"

line 66, after "24" insert --and a channel 24*a* in open communication with atmospheric air--

Signed and Sealed this

Twenty-first Day of October 1997

*Attest:*

BRUCE LEHMAN

*Attesting Officer*

*Commissioner of Patents and Trademarks*